US012453431B2

(12) United States Patent
Armbruster et al.

(10) Patent No.: US 12,453,431 B2
(45) Date of Patent: Oct. 28, 2025

(54) MULTI-MODAL CHILDREN'S ACCESSORY SYSTEM AND KIT

(71) Applicant: KIDS2, LLC, Atlanta, GA (US)

(72) Inventors: Michael Dean Armbruster, Alpharetta, GA (US); John Dave Derubes, Alpharetta, GA (US); Casey Hopper Harris, Brookhaven, GA (US); Colleen Hattler, Woodstock, GA (US); Cheng-Fang Lee, Atlanta, GA (US); Heather Tootell, Atlanta, GA (US); Joseph Mazoyer, Lyons (FR); Philippe Bajard, Lyons (FR)

(73) Assignee: Kids2, LLC, Atlanta, GA (US)

( * ) Notice: Subject to any disclaimer, the term of this patent is extended or adjusted under 35 U.S.C. 154(b) by 74 days.

(21) Appl. No.: 18/513,100

(22) Filed: Nov. 17, 2023

(65) Prior Publication Data

US 2024/0164548 A1 May 23, 2024

Related U.S. Application Data

(60) Provisional application No. 63/426,125, filed on Nov. 17, 2022.

(51) Int. Cl.

| | |
|---|---|
| ***A47D 13/10*** | (2006.01) |
| ***A47D 3/00*** | (2006.01) |
| ***A47D 11/00*** | (2006.01) |
| ***A47D 13/06*** | (2006.01) |
| ***A47D 15/00*** | (2006.01) |

(52) U.S. Cl.
CPC ..... *A47D 11/00* (2013.01); *A47D 3/00* (2013.01); *A47D 13/06* (2013.01); *A47D 13/107* (2013.01); *A47D 15/00* (2013.01)

(58) Field of Classification Search
CPC ..... A47D 15/00; A47D 15/003; A47D 3/00; A47D 3/001; A47D 13/107; A47D 13/06; A47D 13/10
See application file for complete search history.

(56) References Cited

U.S. PATENT DOCUMENTS

| | | | | |
|---|---|---|---|---|
| 4,571,200 A | | 2/1986 | Serna | |
| 5,035,013 A | * | 7/1991 | Bloom | A47D 13/063 190/1 |
| 5,413,488 A | * | 5/1995 | Gibson | G09B 19/00 434/432 |

(Continued)

FOREIGN PATENT DOCUMENTS

| | | | | |
|---|---|---|---|---|
| CA | 2774860 C | * | 10/2015 | A63H 33/006 |
| CN | 105231725 B | * | 3/2018 | A47D 13/00 |

(Continued)

*Primary Examiner* — Justin C Mikowski
*Assistant Examiner* — Ifeolu A Adeboyejo
(74) *Attorney, Agent, or Firm* — Perilla Knox & Hildebrandt LLP

(57) ABSTRACT

A system, method and/or kit for assembling multiple different children's accessories using shared or modular components or parts to assembly multiple different accessory modalities or configurations. In example embodiments, the multiple different accessory modalities or configurations may include one or more of a gym or play mat, a play gym, an activity jumper, an activity center, a play table, and/or a playhouse.

8 Claims, 11 Drawing Sheets

(56) References Cited

U.S. PATENT DOCUMENTS 5,451,093 A * 9/1995 Petrie ..... A47D 13/101 297/282
5,928,054 A * 7/1999 Mast ..... A63H 33/006 446/268
5,930,854 A * 8/1999 O'Neill ..... A47D 13/063 135/96
6,089,654 A 7/2000 Burstein
6,098,217 A 8/2000 Hammil
6,182,581 B1 2/2001 Boyce
6,408,463 B1 6/2002 Palacio
6,532,701 B2 3/2003 Williams
6,848,460 B2 * 2/2005 Zheng ..... E04H 15/40 135/137
6,895,611 B2 5/2005 Tharalson et al.
7,752,693 B2 7/2010 Espenshade
8,458,829 B2 6/2013 Thorne et al.
8,986,064 B2 3/2015 Spielberger et al.
9,895,005 B2 2/2018 Castilla
2002/0164917 A1 * 11/2002 Keegan ..... A47D 13/043 297/1
2005/0176342 A1 * 8/2005 Jackson ..... A47D 3/005 446/227
2007/0192961 A1 * 8/2007 Tidwell ..... A47D 13/083 5/655
2010/0221974 A1 9/2010 Monaghan
2011/0012408 A1 * 1/2011 Lee ..... A47D 1/10 297/217.4
2011/0014844 A1 1/2011 Henson et al.
2013/0244533 A1 * 9/2013 Elson ..... A63H 33/006 446/227
2014/0194031 A1 * 7/2014 Tobias ..... A63H 33/008 446/227
2016/0286977 A1 * 10/2016 Thomson ..... A47D 13/107
2016/0374481 A1 * 12/2016 Sclare ..... G03B 29/00 5/93.2
2017/0232355 A1 * 8/2017 Healy ..... A47D 3/001 446/227
2017/0282951 A1 * 10/2017 Burns ..... B62B 9/20
2018/0056203 A1 * 3/2018 Hansen ..... A63H 33/40
2019/0116988 A1 * 4/2019 Roberts ..... A47D 15/006
2020/0022506 A1 * 1/2020 Mastrosimone-Gese ..... A47D 15/003
2020/0085207 A1 * 3/2020 Renno ..... A47D 13/043
2020/0397146 A1 * 12/2020 Lodato ..... A47D 3/001
2021/0361078 A1 * 11/2021 Logan ..... A47D 11/002
2021/0401190 A1 12/2021 Tyneski et al.
2024/0138591 A1 * 5/2024 Khemka ..... A47D 13/063

FOREIGN PATENT DOCUMENTS

CN 220459033 U 2/2024
TW I830465 B 1/2024
TW 202416875 A 5/2024
WO WO-2016125026 A1 * 8/2016 ..... A47D 1/02
WO 2023245085 A1 12/2023

* cited by examiner

MULTI-MODAL CHILDREN'S ACCESSORY SYSTEM AND KIT

CROSS-REFERENCE TO RELATED APPLICATION

This application claims the benefit of U.S. Provisional Patent Application Ser. No. 63/426,125 filed Nov. 17, 2022, the entirety of which is hereby incorporated herein by reference for all purposes.

TECHNICAL FIELD

The present disclosure relates generally to the field of children's accessories, and more particularly to a multi-modal, convertible, modular system and kit for assembling multiple different children's accessories using shared or modular components.

BACKGROUND

Parents and caregivers of children often wish to provide accessories for care, entertainment and development of a child. For example, play mats and play gyms can provide a comfortable space for an infant to play and develop motor skills. Activity centers and jumpers may be used to help a child develop leg strength and balance during the infant to toddler transition, and to further develop motor skills, coordination, and recognition of colors, shapes, and objects. Toddlers and older children may utilize play tables, playhouses, and other accessories during play and learning activities.

Typically, such accessories are provided separately, requiring parents and caregivers to purchase multiple different accessories for different activities and different stages of child development. This may result in expense, waste, storage requirements and other inefficiencies.

Accordingly, it has been found that needs exist for improved children's accessory systems and methods. It is to the provision of improved children's accessory systems and methods meeting these and other needs that the present disclosure is primarily directed.

SUMMARY

In example embodiments, the present disclosure provides improved children's accessory systems and methods, for example in the form of a multi-modal, convertible modular system and kit, and associated methods, for assembling multiple different children's accessories using shared or modular components. One or more parts, components or subassemblies may be utilized in common between multiple accessory modalities, potentially reducing the need for separate accessory items for different activities and different stages of development.

Accordingly, some measure of expense, waste, storage requirements and/or other inefficiencies may be reduced or eliminated, as compared to previously known children's accessories. Use of the same parts across multiple accessory formats may also assist in a child's acceptance and comfort in transitioning between accessories as the child develops from infant to toddler to preschooler and older childhood, may assist with learning and spatial recognition related to building structures, and may provide opportunities for parent-child interaction and teaching during assembly and reconfiguration of the different accessory modes.

In one aspect, the present disclosure relates to a children's accessory system including a plurality of components configured for assembly into a plurality of different accessory configurations, such as for example, accessory configurations including a gym or play mat, a play gym, an activity jumper, an activity center, a play table, a playhouse, a play tunnel, a tummy mat, an arts and crafts table, and/or a carry mat.

In another aspect, the disclosure relates to a kit including a plurality of components configured for assembly into a plurality of different accessory configurations, such as for example, accessory configurations selected from one or more of a gym or play mat, a play gym, an activity jumper, an activity center, a play table, a playhouse, a play tunnel, a tummy mat, an arts and crafts table, and/or a carry mat.

In still another aspect, the disclosure relates to methods of providing or using a plurality of components configured for assembly into a plurality of different accessory configurations, such as for example, accessory configurations selected from one or more of a gym or play mat, a play gym, an activity jumper, an activity center, a play table, a playhouse, a play tunnel, a tummy mat, an arts and crafts table, and/or a carry mat.

These and other aspects, features and advantages of the present disclosure will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

DETAILED DESCRIPTION OF EXAMPLE EMBODIMENTS

The present disclosure may be understood more readily by reference to the following detailed description of example embodiments taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
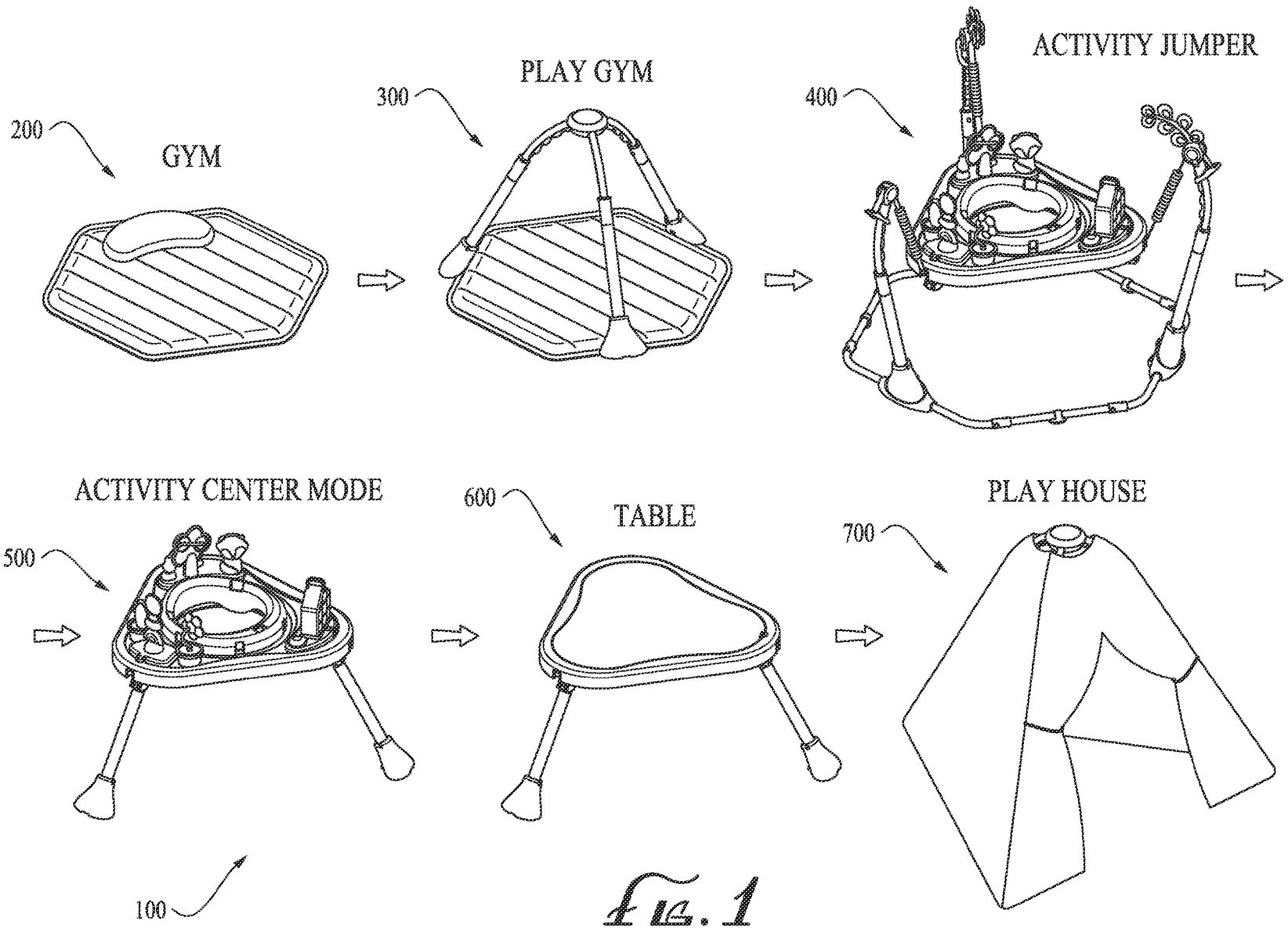
FIG. 1 shows a series of different children's accessory modalities or formats constructed from a system or kit, and according to methods of assembly and use, utilizing shared or modular components, according to example embodiments of the present disclosure.

With reference now to the drawing figures, wherein like reference numbers represent corresponding parts throughout the several views, FIG. 1 shows a series or sequence of different children's accessory modalities or formats constructed from a convertible modular system or kit 100, and according to methods of assembly and use, utilizing shared or modular components, according to example embodiments of the present disclosure. In example embodiments, the system, kit, and/or method provides parts, components or subassemblies that may be utilized in common between different accessory modalities, such as for example one or more, and optionally a plurality of two or more of a gym or play mat, a play gym, an activity jumper, an activity center, a play table, a playhouse, a play tunnel, a tummy mat, an arts and crafts table, and/or a carry mat. All dimensions (e.g., inches or millimeters as indicated in the drawings), materials, patterns, colors and shapes shown are by way of example only, and are not intended to be limiting of the disclosure.

In example embodiments, a system, kit and/or method according to the present disclosure enables the provision, assembly and use of any two or more, three or more, four or more, five or more, or six or more of these and/or other children's accessory modalities or formats. In further example embodiments, a system, kit and/or method according to the present disclosure enables the provision, assembly and use of such children's accessory modalities or formats incorporating at least one, and optionally a plurality of shared or modular parts, components, or subassemblies, including for example, a mat or pad, one or more cushions or pillows, one or more legs or support struts, one or more support feet, a platform, a seat, straps, cords, elastic members, and/or one or more couplings or connection hubs, and various combinations and/or sub-combinations thereof. In further example embodiments, a kit or system according to the present disclosure includes one or more of these and/or other parts, components, or subassemblies in any combination or sub-combination thereof, optionally including packaging or a container for display, storage, and/or transport thereof.

Figure 2:
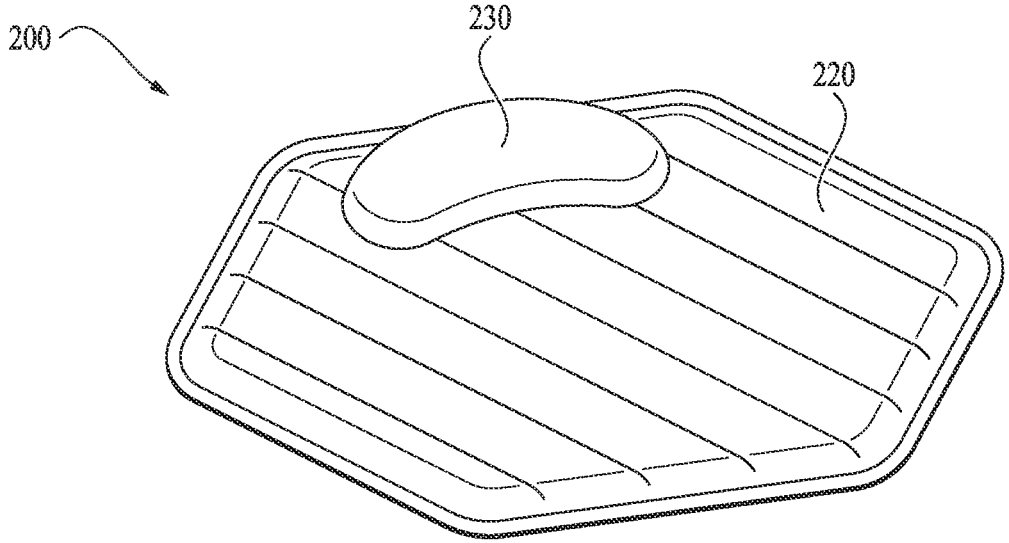
FIG. 2 shows a children's gym or play mat mode or configuration of the system or kit of FIG. 1.

FIG. 2 shows a children's gym or play mat 200 configuration or modality of the system 100. According to the example embodiment depicted, the gym or play mat 200 generally comprises a mat or pad 220, and one or more cushions or pillows 230. The mat or pad 220 may be configured as a generally hexagonal sheet or panel, for example having a foam core and a soft-goods covering, optionally comprising one or more segments or sections attached by flexible webs to allow folding for compact packaging and storage. Alternatively, the mat or pad 220 may be circular, semi-circular, oval, rectangular, square, polygonal, or otherwise configured. The mat or pad 220 optionally includes one or more rounded or radiused corners or edges, and/or one or more cutout segments or openings to receive or surround feet or other components when used in different configurations or modalities. The cushion or pillow 230 may also comprise a foam core and a soft-goods covering, and may be crescent shaped, rectangular, or otherwise configured. In some example embodiments, the cushion or pillow 1230 may also comprise attachment means, such as for example hooks-and-loops fasteners, clips, clasps, or other similar mechanisms, for detachably securing toys and other accessories thereto.

Figure 3:
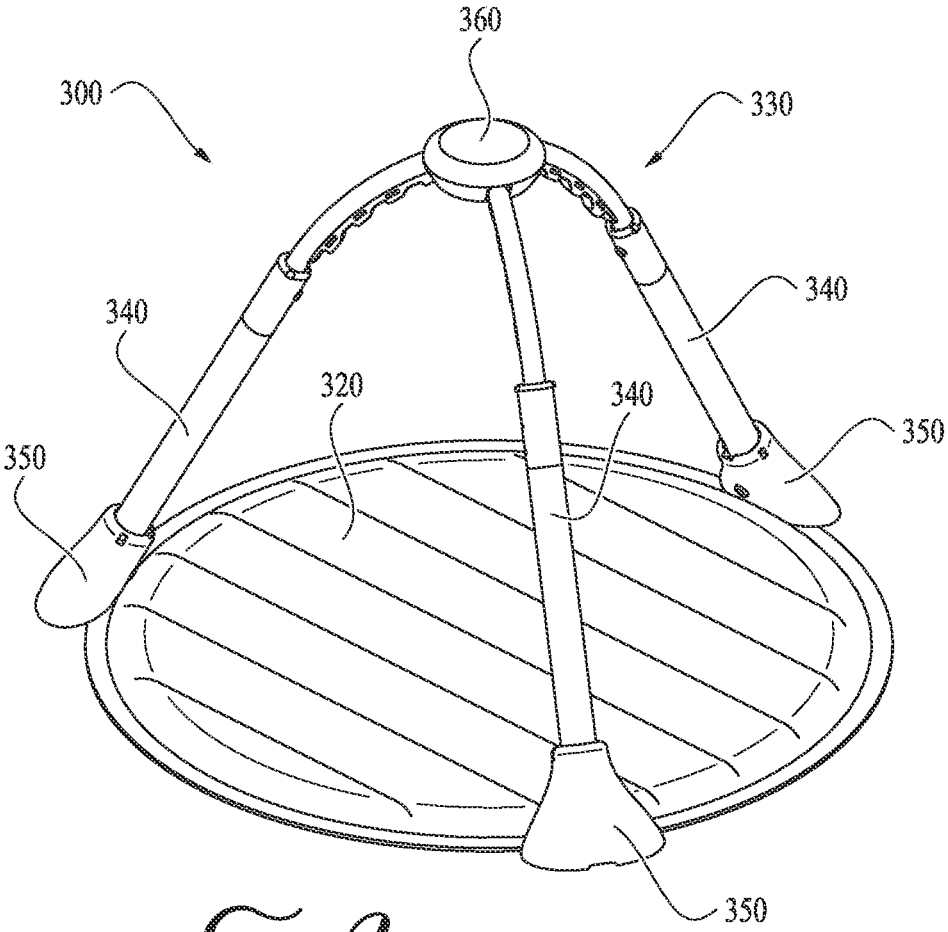
FIG. 3 shows a children's play gym mode or configuration of the system or kit of FIG. 1.

FIG. 3 shows a children's play gym 300 configuration or modality of the system 100. According to the example embodiment depicted, the play gym 300 generally comprises a mat or pad, which in example embodiments may be the same mat or pad 220 as in the children's gym or play mat 200 configuration or modality, or alternatively a different component 320, and an elevated support frame 330 configured to extend over and above the mat or pad 220. The support frame 330 comprises one or more (three in the depicted embodiment) generally upright support members or legs 340, one or more (three in the depicted embodiment) support feet or bases 350 for engagement with the floor or other support surface and from which the support members or legs extend, and at least one coupling element or connection hub 360 for attachment of upper ends of the support members or legs, assembled in a generally tripod configuration. In example embodiments, each of the support members or legs 340 may be of unitary construction or may comprise two or more segments coupled together; and may optionally be configured as straight, curved or arcuate elongate rods, tubes or bars. The support frame 330 may optionally further comprise or support one or more toys or entertainment features suspended or supported above a play space defined along or between the mat or pad 220, 320 and the support frame 330.

Figure 4:
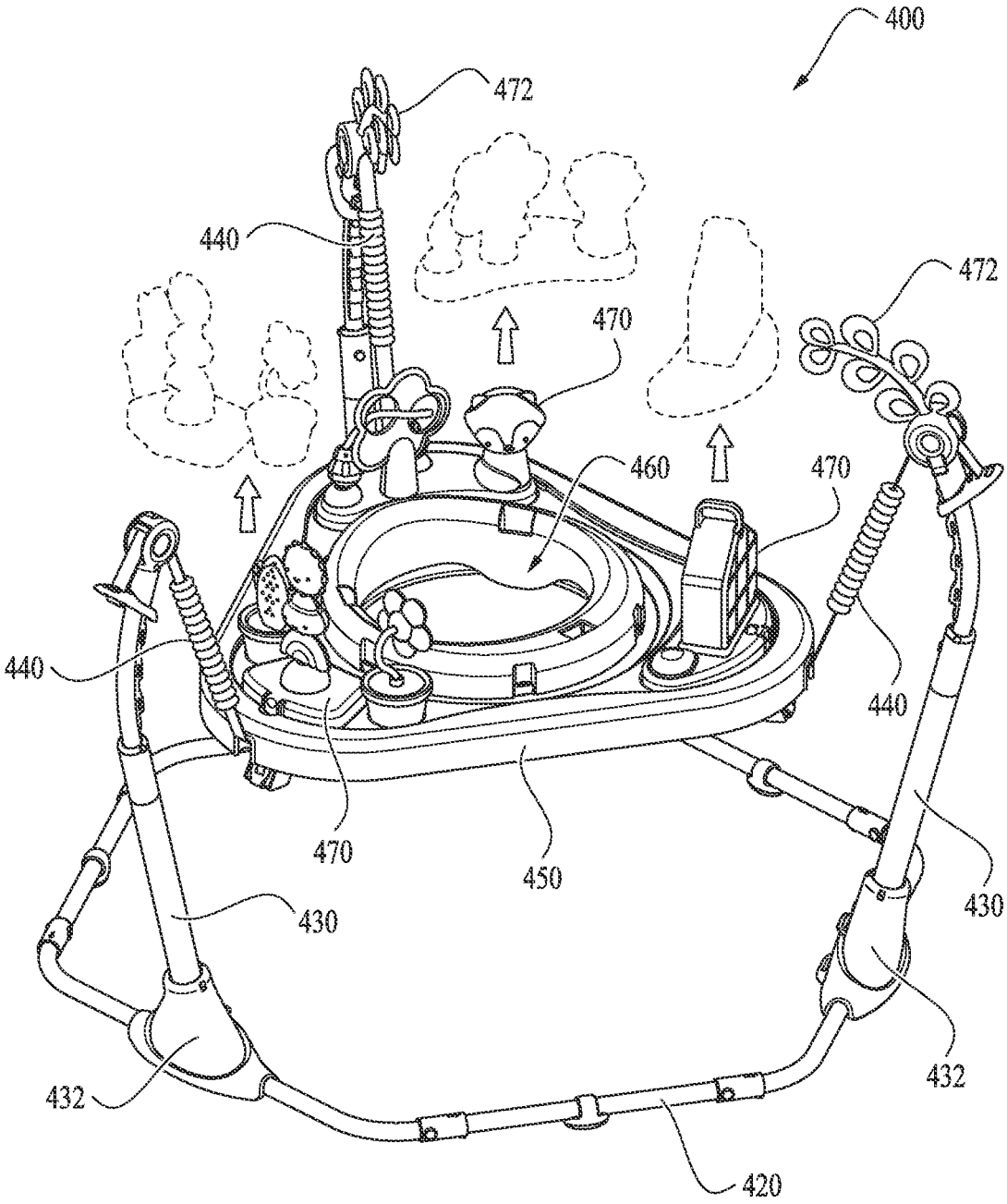
FIG. 4 shows an children's activity jumper mode or configuration of the system or kit of FIG. 1.

FIG. 4 shows a children's activity jumper 400 configuration or modality of the system 100. According to the example embodiment depicted, the activity jumper 400 comprises a base 420, one or more (three in the depicted embodiment) generally upright support members 430, one or more (three in the depicted embodiment) suspension elements 440, a platform 450, and a seat or saddle 460. In example embodiments, the base 420 comprises a hexagonal, or otherwise configured, assembly of interconnected tube segments, optionally configured to surround or circumscribe a hexagonal mat or pad 220 as described above. The tube segments optionally comprise cooperative post and ferrule or sleeve coupling ends, and/or releasable connections such as Valco snap button connectors, or other attachment means, allowing the base to be easily disassembled and broken down for compact packaging, storage and transport, and to be assembled or re-assembled for use without the need for tools. The upright support members 430 may comprise, in whole or in part, the same component(s) as the upright support members or legs 340 of the children's play gym 300 configuration described above, or alternatively may comprise different components or parts. The support members 430 may be connected to the base 420 by coupling elements 432, which optionally may comprise in whole or in part the same components as the feet 350 described above, or alternatively may comprise different parts. The suspension elements 440 preferably comprise flexible and extensible elastic elements, for example comprising a spring or an elastic cord or strap. The length and elasticity of the suspension elements 440 is selectively configured to support the anticipated load including the weight of a small child, supporting the child and allowing the child to bounce in the jumper when in use. The platform 450 comprises a substantially rigid structural body, for example formed of molded plastic or other material having sufficient strength to support the anticipated load including the weight of a small child, and may be generally triangular, circular, square, rectangular, polygonal, or otherwise shaped. The platform 450 preferably defines a generally central opening configured to receive and engage the seat or saddle 460, into which the child is positioned or seated. Optionally, the seat 460 is detachably or releasably coupled to the platform 450 to allow selective attachment and removal by a parent or caregiver, but to prevent accidental detachment when in use. Further optionally, a rotational bearing or coupling assembly allows the seat 460 to rotate relative to the platform 450 within the opening, allowing the child to turn or rotate. Optionally, one or more toys or entertainment features 470 and/or decorative elements 472 may be provided and configured for attachment to the support members 430, to the platform 450, or elsewhere on or around the jumper 400.

Figure 5:
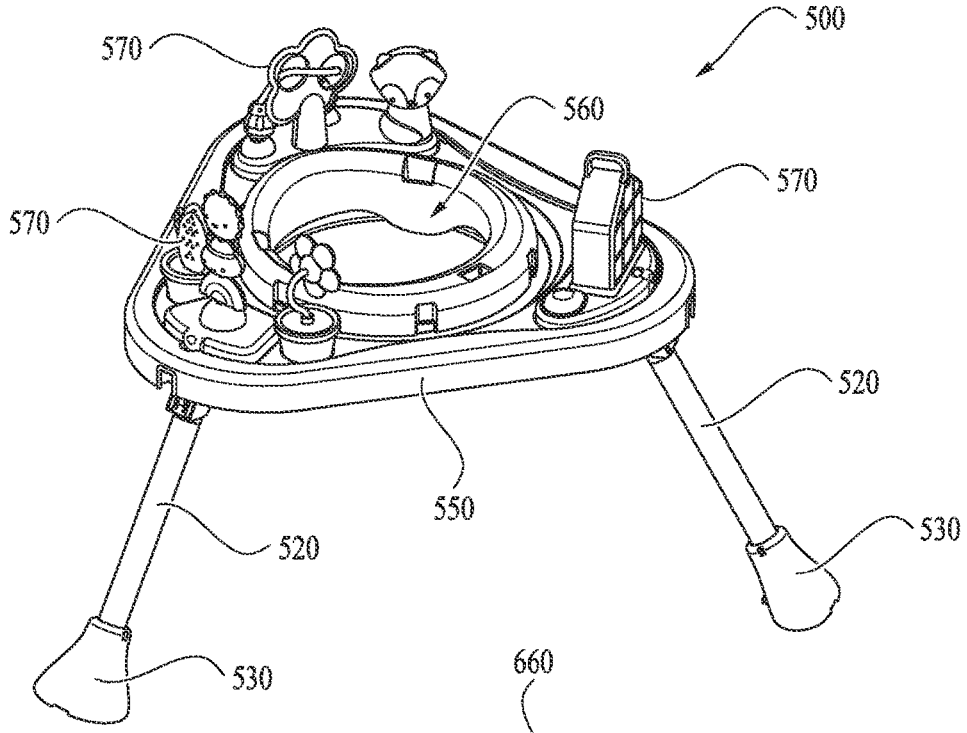
FIG. 5 shows an children's activity center mode or configuration of the system or kit of FIG. 1.

FIG. 5 shows a children's activity center 500 configuration or modality of the system 100. According to the example embodiment depicted, the activity center 500 comprises one or more (three in the depicted embodiment) generally upright support members or legs 520, one or more (three in the depicted embodiment) support feet or bases 530 for engagement with the floor or other support surface and from which the support members or legs extend, a platform 550 supported at an elevated position by the support members, and a seat or saddle 560 mounted to the platform. The upright support members or legs 520 may comprise, in whole or in part, the same component(s) as the upright support members 340 of the children's play gym configuration 300 described above and/or the upright support members 430 of the activity jumper configuration 400 described above, or alternatively may comprise different components or parts. The support feet 530 may comprise, in whole or in part, the same component(s) as the feet 350 and/or the coupling elements 432 described in the embodiments above, or alternatively may comprise different parts. The platform 550 and/or the saddle 560 may comprise, in whole or in part, the same component(s) as the platform 450 and saddle 460 described in the embodiment above, or alternatively may comprise different parts. For example, the platform 550 preferably defines a generally central opening configured to receive and engage the seat or saddle 560, into which the child is positioned or seated. Optionally, the seat 560 is detachably or releasably coupled to the platform 550 to allow selective attachment and removal by a parent or caregiver, but to prevent accidental detachment when in use. Further optionally, a rotational bearing or coupling assembly allows the seat 560 to rotate relative to the platform 550 within the opening, allowing the child to turn or rotate. Optionally, one or more toys or entertainment features 570 may be provided and configured for attachment to platform 550, or elsewhere on or around the activity center 500, which toys or entertainment features may comprise, in whole or in part, the same component(s) as the toys or entertainment features 470 described in the embodiment above.

Figure 6:
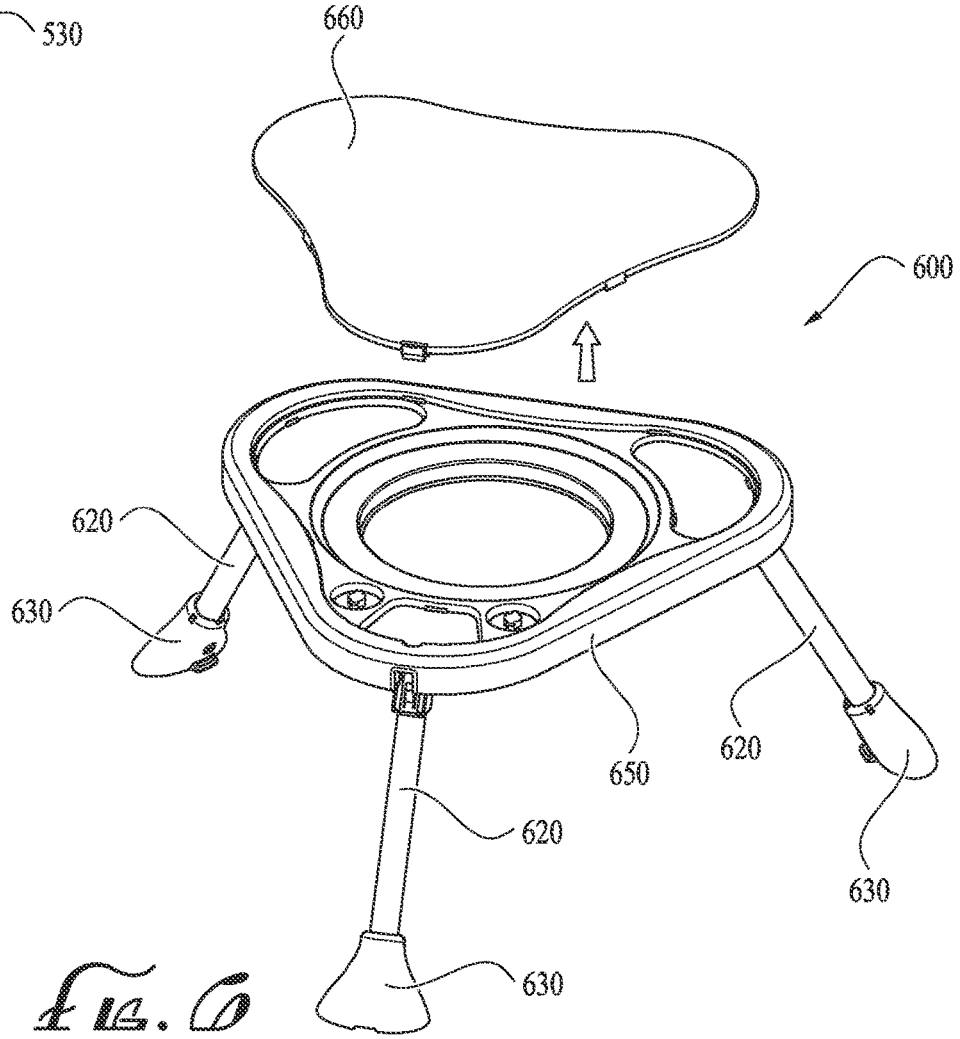
FIG. 6 shows a children's play table mode or configuration of the system or kit of FIG. 1.

FIG. 6 shows a children's play table 600 configuration or modality of the system 100. According to the example embodiment depicted, the play table 600 comprises one or more (three in the depicted embodiment) generally upright support members or legs 620, one or more (three in the depicted embodiment) support feet or bases 630 for engagement with the floor or other support surface and from which the support members or legs extend, a platform 650 supported at an elevated position by the support members, and a top panel or cover 660 configured to be mounted on the top of the platform. The upright support members or legs 620 may comprise, in whole or in part, the same component(s) as the upright support members 340 of the children's play gym configuration 300, the upright support members 430 of the activity jumper configuration 400, and/or the upright support members 520 of the activity center configuration 500, as described above, or alternatively may comprise different components or parts. The support feet 630 may comprise, in whole or in part, the same component(s) as the feet 350, the coupling elements 432, and/or the support feet 530 described in the embodiments above, or alternatively may comprise different parts. The platform 650 may comprise, in whole or in part, the same component as the platform 450 and/or the platform 550 described in the embodiment above, or alternatively may comprise different parts. The top panel 660 is optionally sized and shaped to fit within a corresponding recess within the platform 650, or is otherwise configured to cooperatively and releasably engage with the platform to cover the central opening in which the seat 560 is mounted in other embodiments. The platform 650 defines a generally central opening configured to receive and engage the seat or saddle 560, into which the child is positioned or seated in other configurations. In some example embodiments, the play table 600 optionally comprises a top cover or panel sized and shaped to fit within or over the central opening to provide a flat surface between the receptacles or recesses configured for the toys or entertainment features. In other example embodiments, the play table 600 may be used without any top panel or cover mounted to the platform 650.

Figure 7:
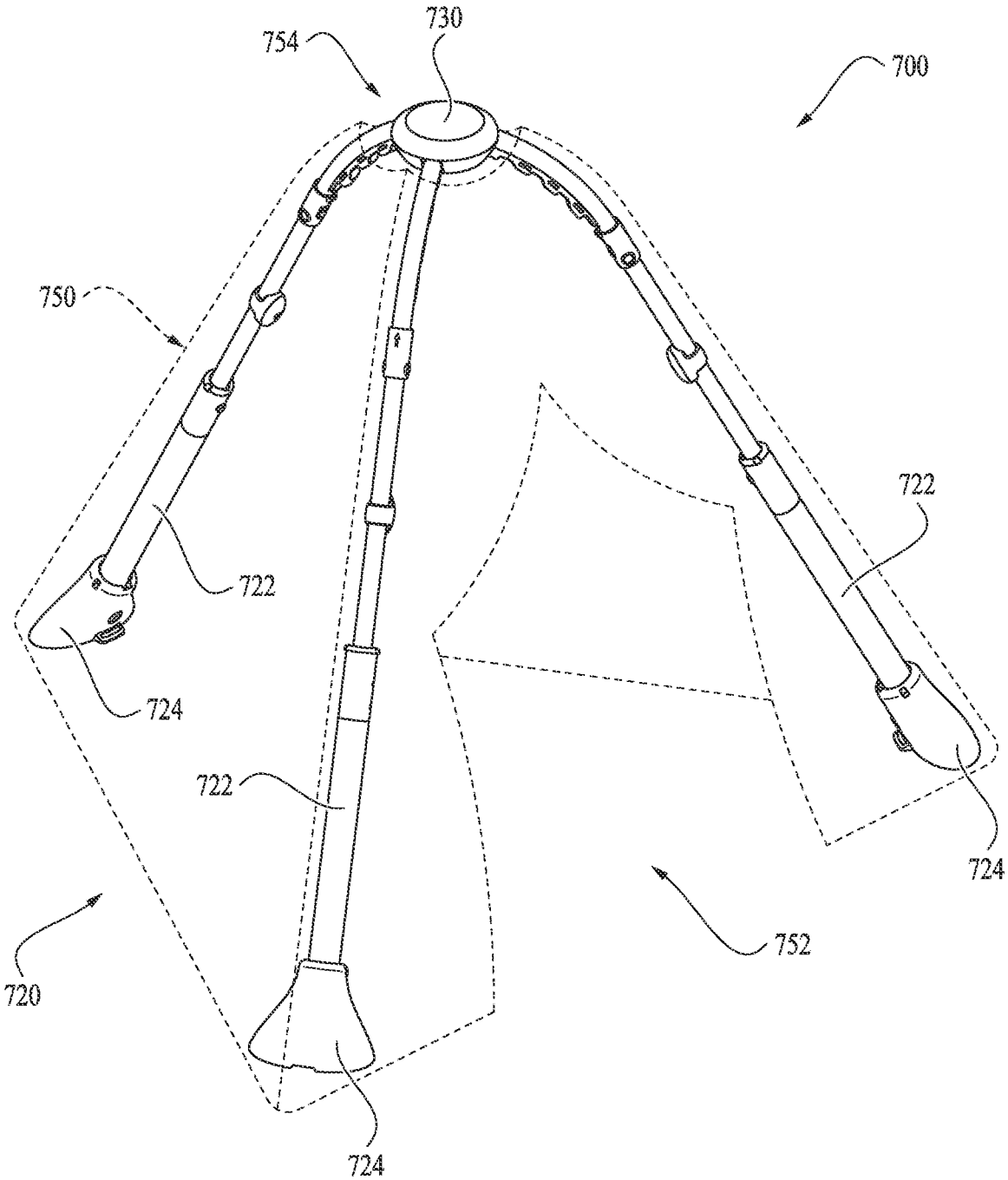
FIG. 7 shows a children's playhouse mode or configuration of the system or kit of FIG. 1.

FIG. 7 shows a children's playhouse or tent 700 configuration or modality of the system 100. According to the example embodiment depicted, the playhouse comprises an inner structural support frame 720 and an outer shell or covering 750. The support frame 720 comprises one or more (three in the depicted embodiment) generally upright support members or legs 722, one or more (three in the depicted embodiment) support feet or bases 724 for engagement with the floor or other support surface and from which the support members or legs extend, and at least one coupling element or connection hub 730 for attachment of upper ends of the support members or legs, assembled in a generally tripod configuration. In example embodiments, each of the support members or legs 722 may be of unitary construction or may comprise two or more segments coupled together; and may optionally be configured as straight, curved or arcuate elongate rods, tubes or bars. The support frame and/or its components (legs 722, feet 724, hub 730) may comprise, in whole or in part, the same component(s) as the support frame 330 of the play gym embodiment 300 described above and its components (legs 340, feet 350, and hub 360, respectively), or alternatively may comprise different parts. In example embodiments, the outer shell or covering 750 comprises a fabric or other flexible soft-goods sheet material having one or more (three in the depicted embodiment) panels or walls, for example configured in generally triangular form, with at least one access opening or door 752, and optionally an upper opening 754 configured to allow the hub 730 to pass therethrough when assembled.

Figure 8:
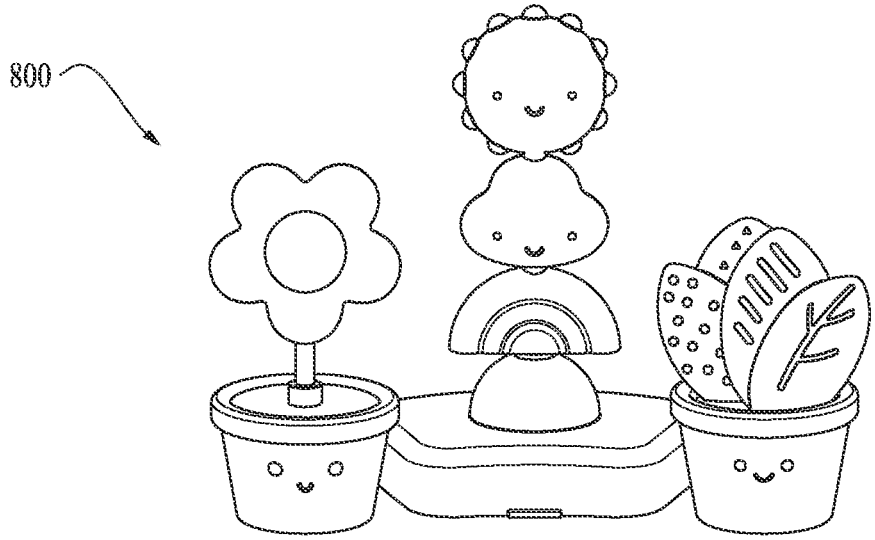
FIG. 8 shows toy accessories or features configured for attachment and use in combination with one or more modes or configurations of the system or kit of FIG. 1.
Figure 9:
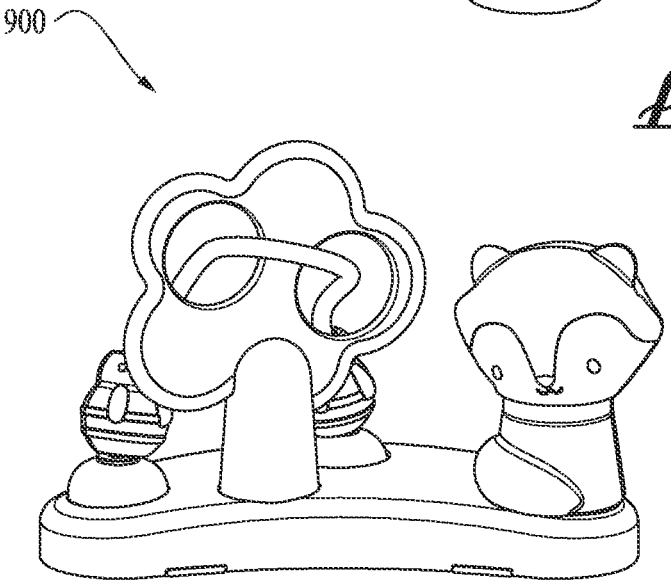
FIG. 9 shows additional toy accessories or features configured for attachment and use in combination with one or more modes or configurations of the system or kit of FIG. 1.
Figure 10:
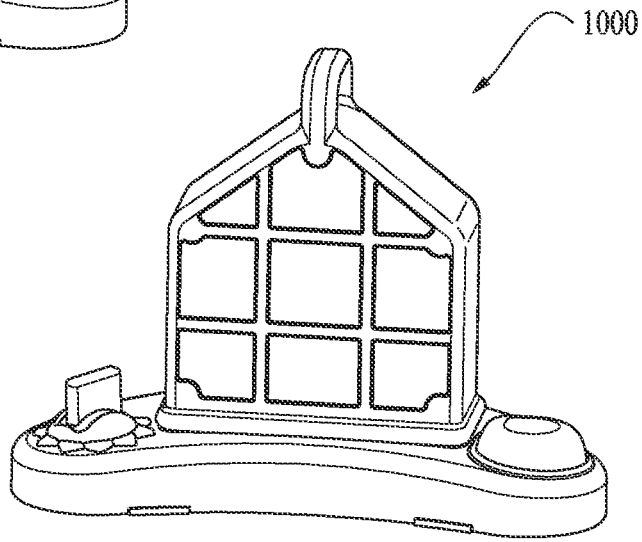
FIG. 10 shows additional toy accessories or features configured for attachment and use in combination with one or more modes or configurations of the system or kit of FIG. 1.

FIGS. 8-10 show toy accessories or entertainment features 800, 900, 1000 configured for attachment and use in combination with one or more modes or configurations of the system or kit as disclosed above. In example embodiments, the same toy accessories or entertainment features 800, 900, 1000 may be the same components configured for interchangeable use between different embodiments or modalities of the system 100, such as for example the toys or entertainment features 470 of the jumper 400, and/or the toys or entertainment features 570 of the activity center 500, or alternatively different toy accessories or entertainment features can be provided for different embodiments or modalities of the system. In some example embodiments, the toy accessories or entertainment features 800, 900, 1000 may comprise one or more interactive components, such as for example, components that rotate or spin or produce visual and/or audio effects in response to a child's interaction with said component or another component.

Figure 11A:
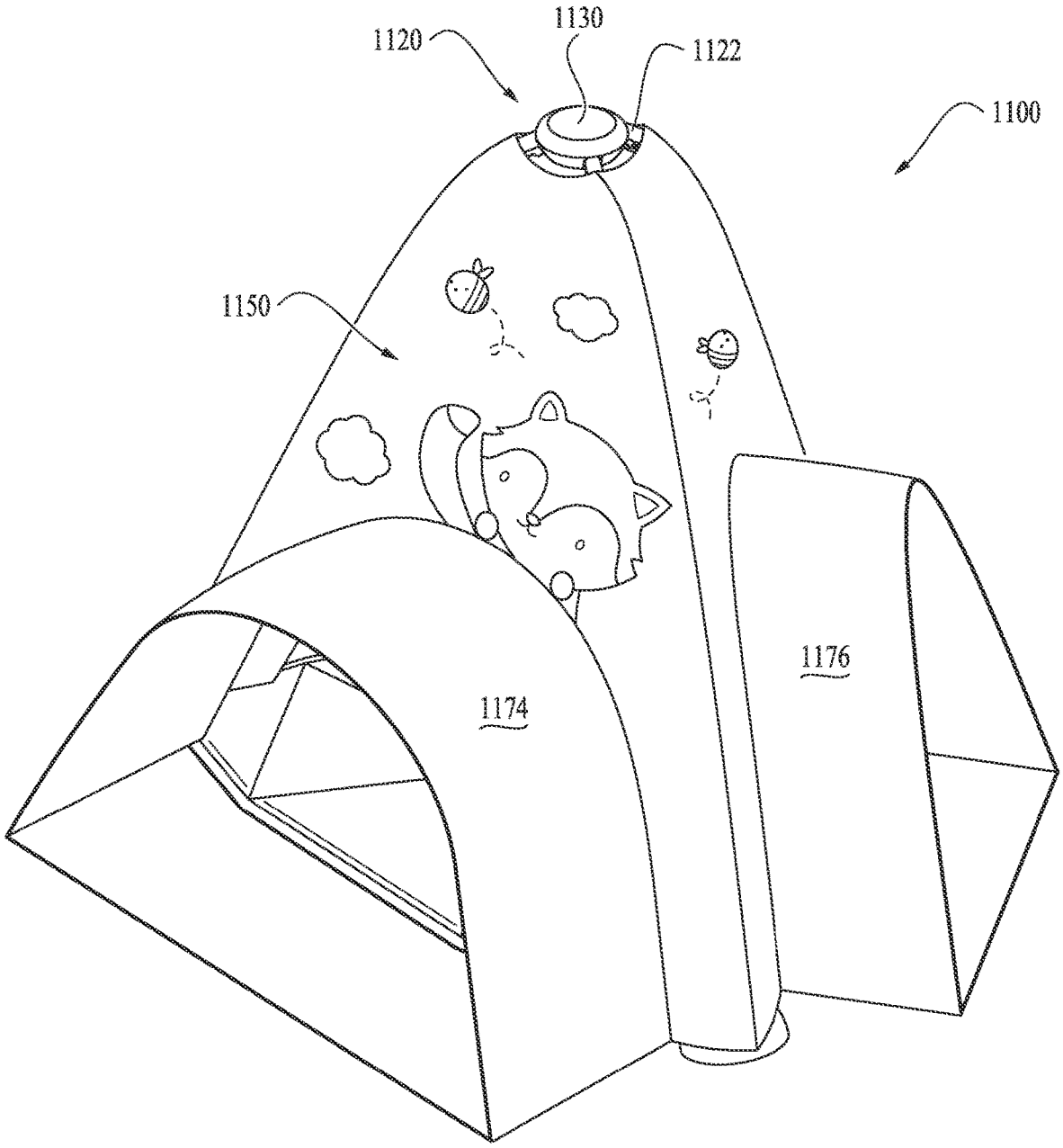
FIGS. 11A, 11B and 11C show a play tunnel mode or configuration of the system or kit of FIG. 1.
Figure 11B:
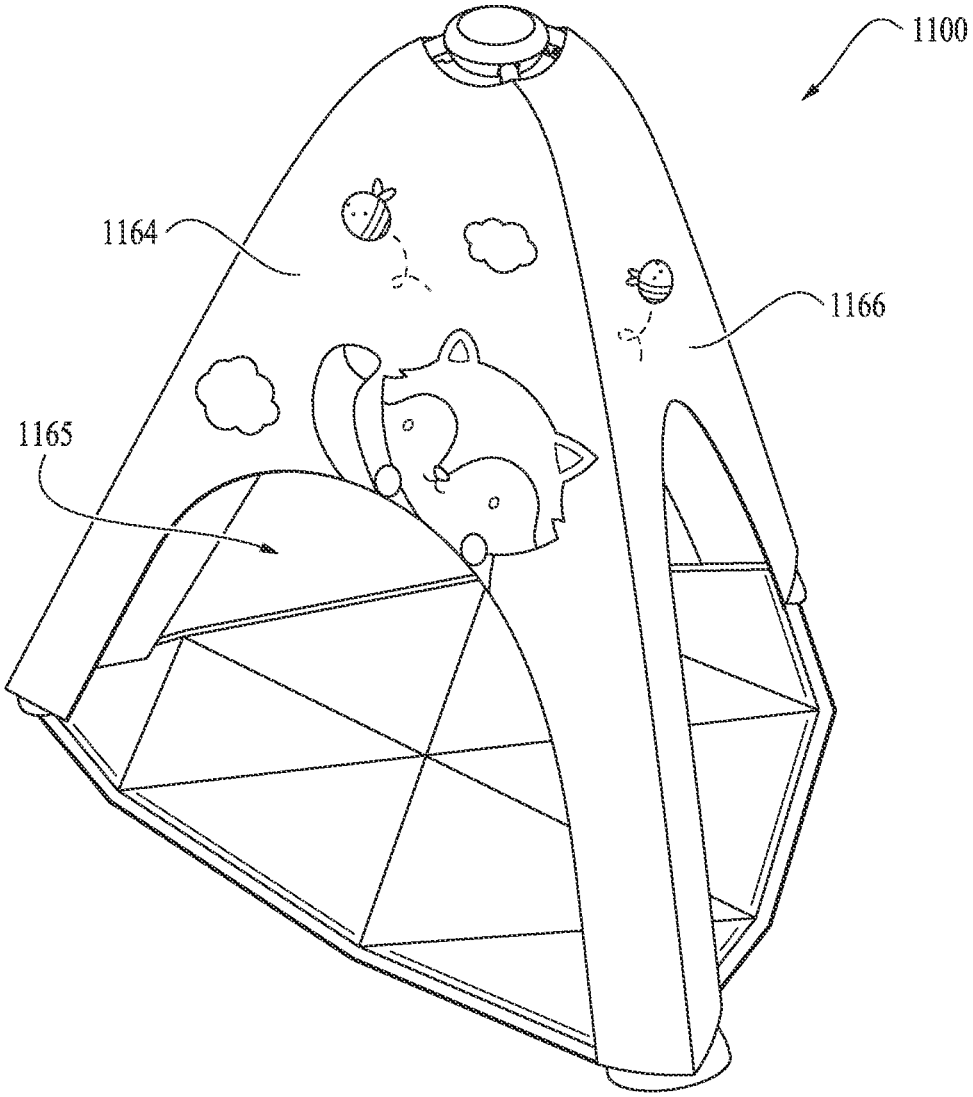
Figure 11C:
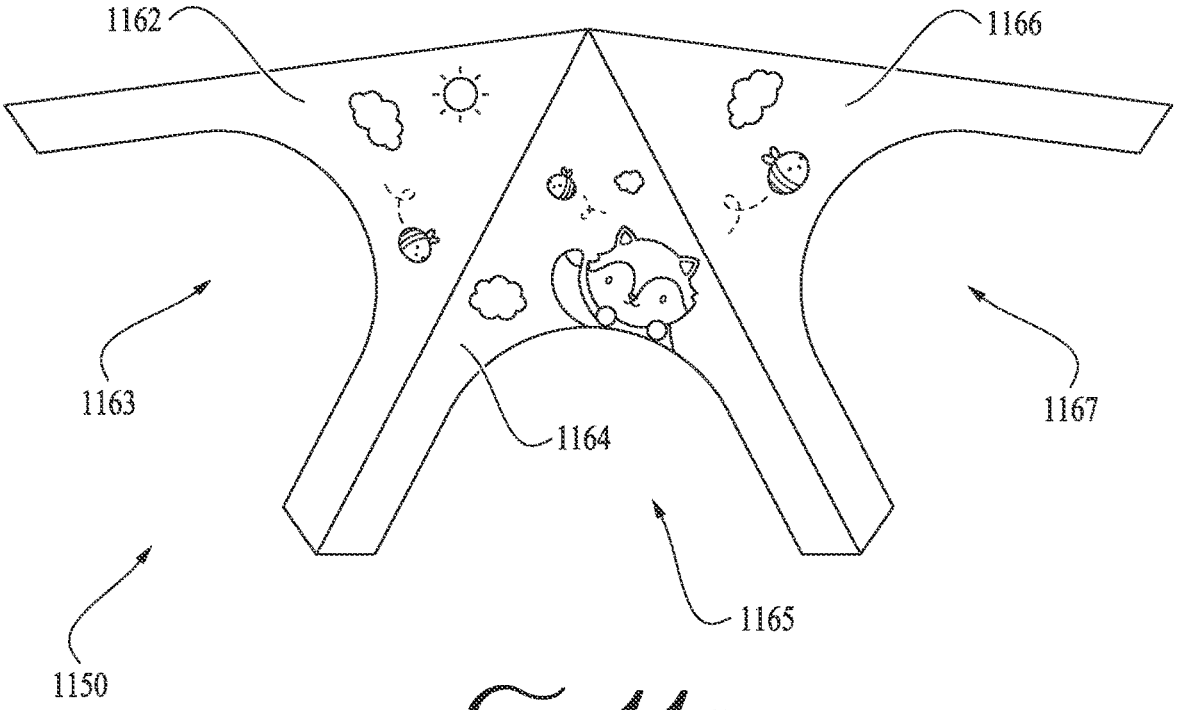

FIGS. 11A, 11B, and 11C show a play tunnel 1100 configuration or modality of the system 100. The play tunnel 1100 is substantially similar to the playhouse or tent 700, with differences as noted. In particular, the play tunnel 1100 comprises an inner structural support frame 1120 and an outer shell or covering 1150. The support frame 1120 comprises one or more (three in the depicted embodiment) generally upright support members or legs 1122, one or more (three in the depicted embodiment) support feet or bases 1124 for engagement with the floor or other support surface and from which the support members or legs extend, and at least one coupling element or connection hub 1130 for attachment of upper ends of the support members or legs, assembled in a generally tripod configuration. In example embodiments, In example embodiments, the outer shell or covering 1150 comprises a fabric or other flexible soft-goods sheet material having one or more (three in the depicted embodiment) generally triangular panels or walls 1162, 1164, 1166, as shown in greater detail in FIG. 11C. One or more of the panels optionally define at least one arcuate cutout portion(s) 1163, 1165, 1167 forming one or more door or access port(s) in the assembled structure. Further optionally, the play tunnel 1100 further comprises one or more tunnel extension panel(s) 1172, 1174, 1176 extending transversely outward from the walls 1162, 1164, 1166 in an arcuate or arched configuration around at least a portion of one or more of the arcuate cutout portion(s) 1163, 1165, 1167 in tunnel-like manner. The support frame 1120 and/or its components (legs 1122, feet 1124, hub 1130) may comprise, in whole or in part, the same component(s) as like elements in the above-described embodiments, or alternatively may comprise different parts.

Figure 12:
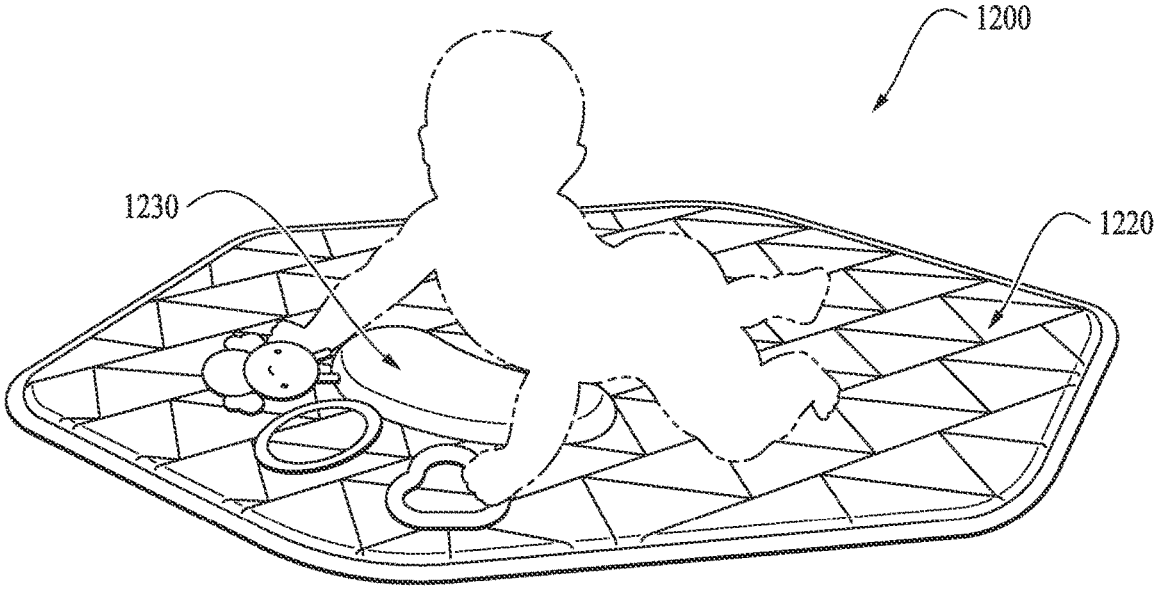
FIG. 12 shows a tummy mat mode or configuration of the system or kit of FIG. 1.

FIG. 12 shows a tummy mat 1200 configuration or modality of the system 100. According to the example embodiment depicted, the tummy mat 1200 generally comprises a mat or pad 1220, and one or more cushions or pillows 1230. The mat or pad 1220 may be configured as a generally hexagonal sheet or panel, for example having a foam core and a soft-goods covering, optionally comprising one or more segments or sections attached by flexible webs to allow folding for compact packaging and storage. Alternatively, the mat or pad 1220 may be circular, semi-circular, oval, rectangular, square, polygonal, or otherwise configured. The mat or pad 1220 optionally includes one or more rounded or radiused corners or edges. The cushion or pillow 1230 may also comprise a foam core and a soft-goods covering, and may be crescent shaped, rectangular, or otherwise configured. In some example embodiments, the cushion or pillow 1230 may also comprise attachment means, such as for example hooks-and-loops fasteners, clips, clasps, or other similar mechanisms, for detachably securing toys and other accessories thereto.

Figure 13:
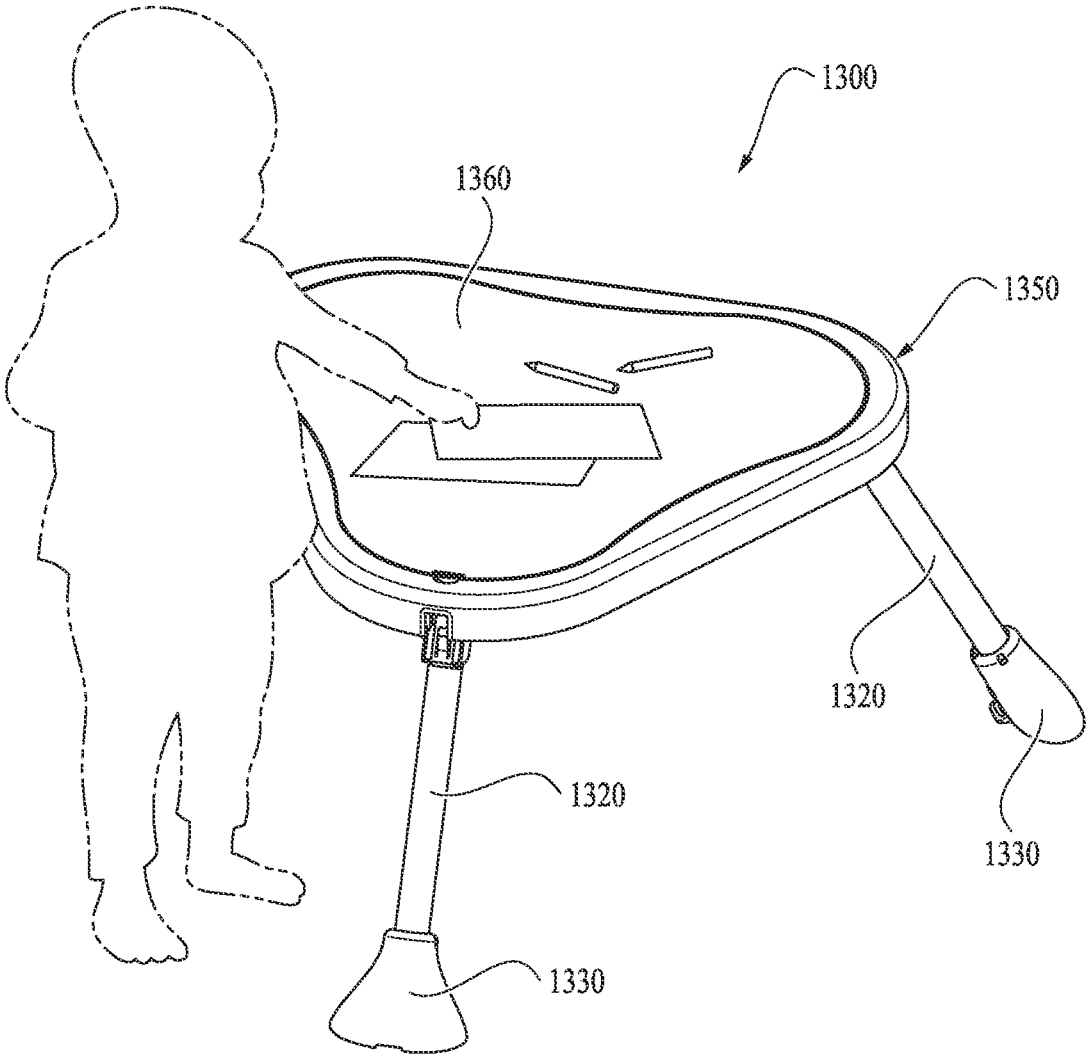
FIG. 13 shows an arts and crafts table or desk mode or configuration of the system or kit of FIG. 1.

FIG. 13 shows an arts and crafts table or desk 1300 configuration or modality of the system 100. In example embodiments, a flat cover will be included to cover toy pockets creating a fully smooth table-top surface. According to the example embodiment depicted, the play table 1300 comprises one or more (three in the depicted embodiment) generally upright support members or legs 1320, one or more (three in the depicted embodiment) support feet or bases 1330 for engagement with the floor or other support surface and from which the support members or legs extend, a platform 1350 supported at an elevated position by the support members, and a top panel or flat cover 1360 configured to be mounted on the top of the platform. Any or all of the upright support members or legs 1320, support feet 1320, platform 1350 and/or flat cover 1360 component(s) may comprise, in whole or in part, the same component(s) as like elements in the above-described embodiments, or alternatively may comprise different parts.

Figure 14:
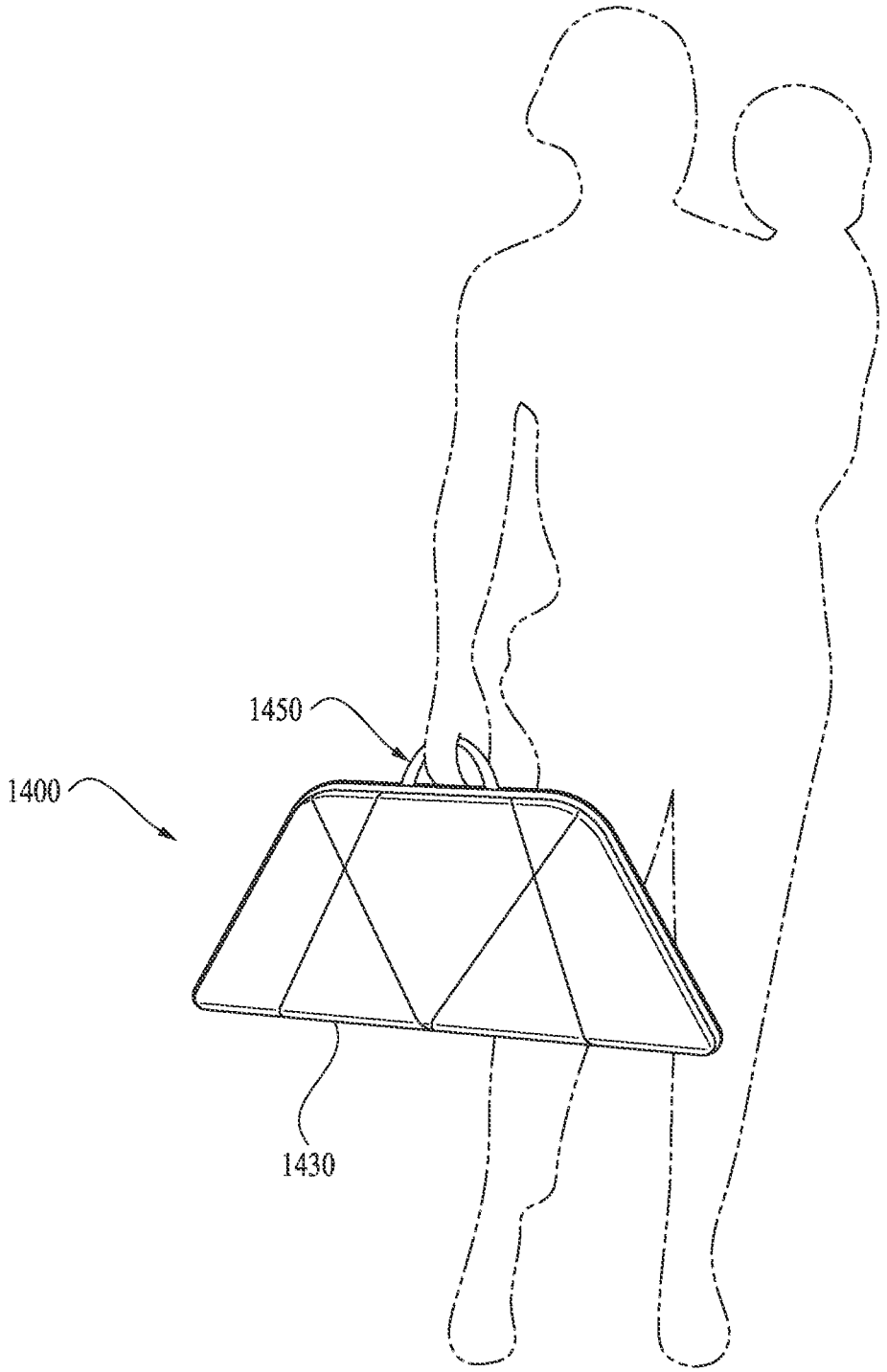
FIG. 14 shows a carry mat mode or configuration of the system or kit of FIG. 1.

FIG. 14 shows a carry mat 1400 configuration or modality of the system 100. The carry mat 1400 may comprise the same or substantially similar component(s) as the above-described gym or play mat 200 and/or the above-described tummy mat 1200, and optionally further comprising a hinged or foldable segment 1430 allowing the panel of the mat to be folded in one or more directions for a more compact carrying configuration, and/or a carrying handle 1450 to allow a user to grasp and carry the mat.

In further example embodiments, any or all of the components sufficient to assemble and use one or more, and preferably a plurality of the configurations or modalities of the system 100 as disclosed herein are provided and combined into a kit, and optionally packaged in a box, carton, bag or other packaging. Optionally, instructions for assembly and use are provided with the kit, and/or online or via other media.

In example methods of use, a user may assemble the various parts as disclosed from the kit or as otherwise provided. Optionally, the components are sold as an assembled structure according to one or more of the disclosed configurations or modalities. Alternatively, the parts are provided in a disassembled fashion. A user selects the parts appropriate for a desired one of the configurations or modalities and assembles the parts to form the desired assembly of the selected configuration or modality of a children's accessory. A child may then utilize the assembled accessory in typical fashion. As a child develops or as different accessories may be desired, the parts may be disassembled and reassembled into another accessory of the disclosed configurations or modalities. When not in use, the parts may optionally be disassembled for compact storage or transport.

While the invention has been described with reference to example embodiments, it will be understood by those skilled in the art that a variety of modifications, additions and deletions are within the scope of the invention, as defined by the following claims.

What is claimed is:

1. A children's accessory system, comprising a plurality of components comprising: a pad, one or more pillows, one or more support legs, one or more support feet, a platform, a seat, a top cover, one or more elastic members, one or more couplings, a connection hub, and an outer shell;

wherein the plurality of components are interchangeable into a plurality of different accessory configurations comprising: a play mat, a play gym, an activity jumper, an activity center, a play table, and a playhouse;

wherein, in the activity jumper configuration, the children's accessory system comprises the one or more support legs, the one or more support feet, the platform, the seat, and the one or more elastic members configurable to support a child and allow the child to bounce;

wherein, in the play gym configuration, the children's accessory system comprises the pad, the one or more support legs, the one or more support feet, and the connection hub;

wherein, in the activity center configuration, the children's accessory system comprises the one or more support legs, the one or more support feet, the platform, and the seat; and wherein, in the playhouse configuration, the children's accessory system comprises the one or more support legs, the one or more support feet, the connection hub, and the outer shell.

2. The children's accessory system of claim 1, wherein the different accessory configurations further comprise a play tunnel, a tummy mat, an arts and crafts table, and a carry mat.

3. The children's accessory system of claim 2, wherein the pad is foldable.

4. The children's accessory system of claim 2, wherein the outer shell comprises a soft-goods sheet material.

5. The children's accessory system of claim 1, wherein the plurality of components further comprises one or more interactive toys detachably mountable to the platform.

6. The children's accessory system of claim 1, wherein, in the activity jumper and activity table configurations, the seat is detachably coupled to the platform and is configured to rotate relative to the platform.

7. The children's accessory system of claim 1, wherein, in the play table configuration, the children's accessory system comprises the one or more support legs, the one or more support feet, the platform, and the top cover.

8. A method of selectively assembling a plurality of components comprising a mat, a connection hub, a support base having plurality of base couplings, a plurality of support members extending between first ends and second ends, a plurality of support feet, a platform, a seat, a top panel, a plurality of suspension members, and an outer covering interchangeably into a plurality of different accessory configurations comprising a play mat, a play gym, an activity jumper, an activity center, a play table, and a playhouse, the method comprising:

for the play mat configuration, providing the mat on a support surface;

for the play gym configuration, providing the mat on the support surface, forming a play gym support frame by coupling the first ends of the support members to the central connection hub and coupling one of the plurality of support feet to the second end of each of the support members, and providing the support frame over the mat;

for the activity jumper configuration, providing the support base on the support surface, coupling the plurality of support members to the support base by the plurality of base couplings, suspending the platform between the support members by the plurality of suspension members coupled between the support members and the platform, and securing the seat within a central opening of the platform;

for the activity center configuration, coupling the platform to the first ends of the support members, coupling one of the support feet to the second end of each support member, and securing the seat within the central opening of the platform, wherein the platform is stably supported by the support members and support feet over the support surface;

for the table configuration, coupling the platform to the first ends of the support members, coupling one of the support feet to the second end of each support member, and mounting the top panel to the platform covering the central opening, wherein the platform is supported by the support members and support feet over the support surface; and for the playhouse configuration, forming an inner support frame by coupling the first ends of the support members to the central connection hub and coupling one of the plurality of support feet to the second end of each of the support members, and securing the outer covering over the inner support frame.

* * * * *